US008834639B2

(12) United States Patent
Sylvestre

(10) Patent No.: US 8,834,639 B2
(45) Date of Patent: Sep. 16, 2014

(54) METHOD OF DRAINING A SYSTEM FOR ANCHORING A STRUCTURAL CABLE TO A CONSTRUCTION ELEMENT

(75) Inventor: Aurélien Sylvestre, Paris (FR)

(73) Assignee: Soletanche Freyssinet, Rueil Malmaison (FR)

( * ) Notice: Subject to any disclaimer, the term of this patent is extended or adjusted under 35 U.S.C. 154(b) by 379 days.

(21) Appl. No.: 13/430,283

(22) Filed: Mar. 26, 2012

(65) Prior Publication Data

US 2012/0247568 A1 Oct. 4, 2012

(30) Foreign Application Priority Data

Mar. 28, 2011 (FR) ..... 11 52557

(51) Int. Cl.

| | |
|---|---|
| ***B08B 7/00*** | (2006.01) |
| ***E01D 19/14*** | (2006.01) |
| ***E01D 22/00*** | (2006.01) |
| ***E04C 5/12*** | (2006.01) |
| ***E01D 19/16*** | (2006.01) |
| ***E04G 21/12*** | (2006.01) |

(52) U.S. Cl.

CPC ..... *E01D 19/14* (2013.01); *E01D 22/00* (2013.01); *E04C 5/12* (2013.01); *E01D 19/16* (2013.01); *E04G 21/12* (2013.01)

USPC ..... 134/19

(58) Field of Classification Search

None

See application file for complete search history.

(56) References Cited

U.S. PATENT DOCUMENTS 4,473,936 A * 10/1984 Kellner et al. ..... 29/458
5,173,982 A * 12/1992 Lovett et al. ..... 14/22

FOREIGN PATENT DOCUMENTS

| | | |
|---|---|---|
| GB | 608593 | 9/1948 |
| GB | 2148351 | 5/1985 |
| GB | 2148351 A * | 5/1985 |

* cited by examiner

*Primary Examiner* — Nicole Blan

(74) *Attorney, Agent, or Firm* — Mckenna Long & Aldridge LLP

(57) ABSTRACT

Method of draining a system for anchoring a structural cable to a construction element, the anchor system comprising a first chamber delimited by an envelope, the first chamber containing a first part of the structural cable and a first filling material, the method comprising: inserting at least one heating element into the first filling material via an opening in the envelope of the first chamber; heating the first filling material with the aid of the heating element to fluidize some or all of the first filling material; and extracting the fluidized first filling material via an opening in the envelope of the first chamber.

12 Claims, 2 Drawing Sheets

METHOD OF DRAINING A SYSTEM FOR ANCHORING A STRUCTURAL CABLE TO A CONSTRUCTION ELEMENT

This application claims priority to French Patent Application No: 1152557, filed Mar. 28, 2011, the content of which is incorporated by reference in its entirety for all purposes as if fully set forth herein.

BACKGROUND OF THE INVENTION

The present invention concerns a method of draining a system for anchoring a structural cable to a construction element.

The structural cable in question may be a stay, a suspension cable or a prestressing cable.

It is routine for the structural cables usually encountered to comprise a plurality of strands each of which includes metal wires themselves wrapped together in a protective sheath. Each of these protective sheaths is interrupted at the level of a terminal end so that the strands each have a stripped end section.

The anchoring systems usually encountered include:

- a perforated anchor block to which are individually anchored the stripped end section or sections of the cable,
- a bearing surface that is fixed with respect to the construction element and against which the perimeter of the perforated block bears axially,
- one or more chambers containing stripped parts of the structural cable (possibly divided into strands) together with a filling material. There is generally a first chamber situated on the side of the anchor block from which the structural cable arrives and inside which the protective sheaths are interrupted.

The filling material is generally a petroleum wax or a grease. It is injected hot into the chamber or chambers of the anchorage after fitting the cable and anchoring it. After cooling, it forms a solid or a thick paste that adheres to the stripped cable and provides the required seal.

Now it may prove useful to change the filling material, either during construction because it has not been injected correctly, or during the service life of the construction work, during maintenance operations on the anchor system. For some chambers of the anchor system, this does not give rise to any problem. For example, for a chamber located under a cap and containing the end part of the structural cable that emerges from the anchor block, the filling material may be removed with the aid of a trowel and/or a flow of hot air.

At present, there is no method for draining some chambers of the anchor system to which access is difficult, for example a chamber situated behind the anchor block, in a part of the anchor system buried in the construction work.

An object of the present invention is to solve some or all of the problems referred to above, that is to say in particular to provide a method for draining an anchor system of a structural cable including a chamber filled with a filling material to which access is difficult.

SUMMARY OF THE INVENTION

The solution of the invention relates to a method of draining a system for anchoring a structural cable to a construction element, the anchor system comprising a first chamber delimited by an envelope, the first chamber containing a first part of the structural cable and a first filling material, the method comprising:

- inserting at least one heating element into the first filling material via an opening in the envelope of the first chamber;
- heating the first filling material using the heating element to fluidize at least some of the first filling material; and
- extracting the fluidized first filling material via an opening in the envelope of the first chamber.

Although solid at ambient temperature, the filling material is relatively soft and it is possible to insert a heating element into it. The filing material generally occupies the whole of the first chamber, in such a manner as to envelop the stripped part of the cable. The filling material may have a role of protecting the cables that it surrounds.

In the insertion step, at least one heating element is passed through an opening in the envelope delimiting the first chamber. It may be advantageous to use a plurality of heating elements passing through a plurality of openings, or through the same opening, to accelerate heating.

The opening or openings may be pre-existent, for example holes in the anchor block that were used to fill the chamber. Alternatively, the openings may be produced specially for the draining operation.

By "fluidize" is meant "render sufficiently fluid to be able to flow through an opening of the type used to introduce the heating element". For wax, it is liquefaction. For grease, it is sufficiently reducing viscosity.

The heating element may be of any kind appropriate to the filling material to be fluidized, without it catching fire. If the structural cable is partly sheathed in the chamber, care must also be taken not to damage the sheath, which generally melts at around 180° C.

It is thus possible to circulate a heat-transfer fluid in the heating element, the fluid having been heated beforehand. Heat may also be produced directly in the heating element, within the filling material to be heated.

The object of heating is normally to fluidize all of the filling material, or at least a great part of it. At the least the filling material is fluidized in an area in which it is in contact with the stripped cable.

Heat is communicated from the heating element to the filling material being fluidized. The hot filling material moves by convection and contributes to melting the remaining material.

The fluidized filling material is extracted via an opening in the envelope of the first chamber. This opening may be the same as that used for the introduction of the heating element or elements. A plurality of openings may be used for this extraction, to facilitate removal of all the liquid.

The method is relatively simple to use. It enables the filling material to be drained in a manner that is relatively non-intrusive, without notably degrading the anchor structure. The latter remains functional and may be refilled with filling material.

In particular embodiments, the invention may use one or more of the following features:

- The heating element comprises a substantially cylindrical part having an end by which it is caused to penetrate into the first filling material during the insertion step. Such a shape, for example a tube shape, facilitates penetration of the heating element into the filling material, which is a more of less soft solid. The end may be pointed to facilitate penetration further.
- The heating element comprises an electrical resistor, the method further comprising a step of connection of the electrical resistor to a current source. A heating element containing an electrical resistor is easy to manipulate and to install in the anchor system. It necessitates only a connection to a source of current.

The heating element comprises a thermocouple for measuring a temperature in the vicinity of the heating element. By "in the vicinity" is meant "in or near". The measurement may notably be effected at the end of the heating element that penetrates into the filling material. This measurement enables the evolution of the temperature in the chamber to be tracked, notably in the vicinity of the heating element.

During the heating step, the heating element delivers a thermal power regulated as a function of the temperature measured by the thermocouple. This makes it possible to reduce the heating time and to prevent overheating that could degrade any protective sheath present on a part of the structural cable or cause the filling material to catch fire.

During the heating step, the opening of the envelope of the first chamber through which the heating element is introduced is sealed against flow of the fluidized first filling material. This makes it possible to prevent the chamber being progressively emptied of its fluidized filling material. For good conduction of heat and optimum fluidization of the filling material, it is preferable that all the fluidized material remain in the chamber during the heating step. The seal may be obtained thanks to sealing means (for example a seal) disposed on the heating element.

The fluidized first filling material is extracted at least in part by aspiration using a cannula. This enables evacuation of the fluidized filling material, even when the opening through which it is effected is situated above the liquid material. This may for example occur in a system for anchoring the top part of a bridge stay.

The fluidized first filling material is extracted at least in part by flow. If the opening used to extract the fluidized filling material is situated in the bottom part of the chamber, this mode of evacuation is simple and effective.

The fluidized first filling material flows through the opening that was used to introduce the heating element into the first filling material. The heating element may be removed after the heating step, for example, and the passage may be freed for a flow of the fluidized filling material. Thus an additional opening is of no utility for the evacuation.

The envelope of the first chamber comprises an anchor block to which the structural cable is anchored, a tube and a gland, the opening through which the heating element is introduced into the first filling material during the insertion step being situated in the anchor block. In this embodiment, there is used for the insertion of the heating element an opening, generally a pre-existing opening, in the anchor block. The opening therefore does not need to be created specially.

The anchor system comprises a second chamber situated on the other side of the anchor block relative to the first chamber and delimited by a second envelope comprising the anchor block and a cap, the second chamber containing a second part of the structural cable and a second filling material and wherein, prior to the insertion of the heating element into the first filling material, the heating element is caused to penetrate into the second chamber via an opening in the cap aligned with the opening in the envelope of the first chamber through which the heating element is inserted to enable successive penetration of the heating element into the second chamber and then the first chamber without moving the cap. Some anchor systems have a second chamber in which the end part or parts of the structural cable that project(s) from the anchor block is/are situated. This second chamber is delimited by the anchor block and by a cap. It contains a second filling material. It has the same function as the first filling material and may consist of the same material. In this embodiment, the heating element penetrates first into the second chamber and then into the first chamber, via two openings configured so as not to have to move the cap.

The method further comprises a step of heating the second filling material by a heating belt placed on an external surface of the cap. The second filling material may be fluidized by external heating with the aid of a heating belt placed externally of the chamber, against the cap, and then removed.

BRIEF DESCRIPTION OF THE DRAWINGS

Other features and advantages of the present invention will become apparent in the following description of nonlimiting embodiments given with reference to the appended drawings, in which.

DESCRIPTION OF PREFERRED EMBODIMENTS

For reasons of clarity, the dimensions of the various elements represented in these figures are not necessarily in proportion to their real dimensions. In the figures, identical references correspond to identical elements, but not necessarily used in an identical manner.

Figure 1A:
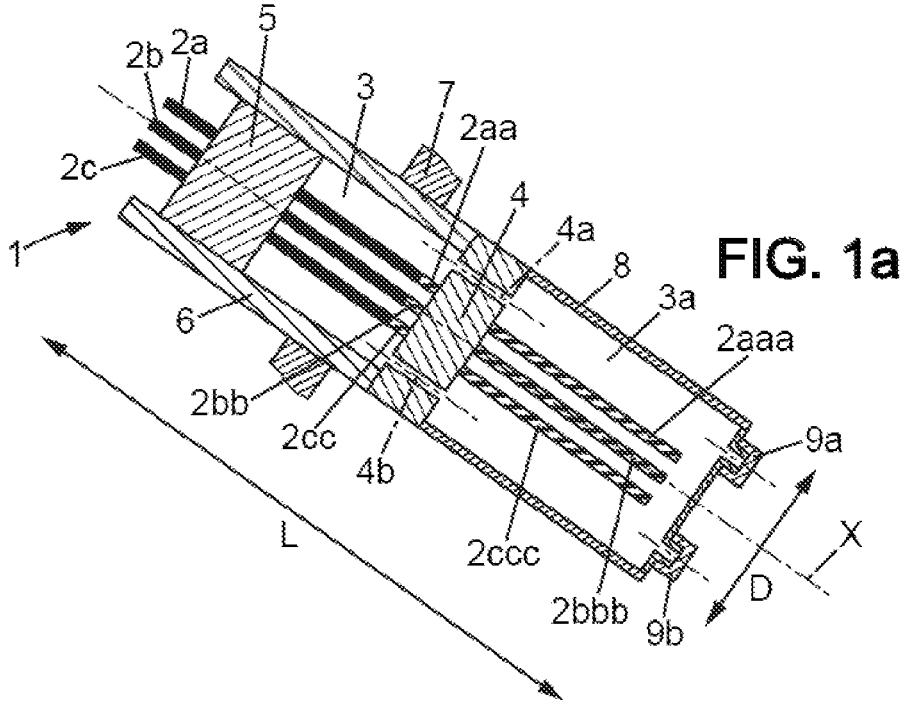
FIG. 1*a* represents diagrammatically a longitudinal section of a system for anchoring a structural cable to a construction element.

In FIG. 1*a*, the structural cable considered is for example the bottom part of a bridge stay oriented in a direction X. The cable is composed of a plurality of strands. Three of them are shown: 2*a*, 2*b*, 2*c*. The structural cable (that is to say its strands 2*a*, 2*b*, 2*c*) is anchored thanks to an anchor system 1 bearing axially on a construction element 7 (for example a bridge bearing surface). The anchor system has for example a length of approximately 600 to 1000 mm in the direction X and a diameter of approximately 200 to 600 mm in a plane orthogonal to that direction.

Each strand is itself formed of a plurality of individual wires. These wires may be parallel or twisted and for example produced in or galfanized steel. The strands 2*a*, 2*b*, 2*c* are each surrounded by a protective sheath that is adapted to protect them during their service life against corrosion caused by intemperate weather or other environmental aggression, and notably from moisture and handling. The sheath is made for example in a plastic material such as high-density polyethylene (PEHD) or a polyamide.

The structural cable is anchored to a perforated block 4, or anchor block, for example by clamping the ends of the strands into split jaws (not shown). To this end, each of the protective sheaths of the strands is interrupted at the level of a terminal end so that the cable has a stripped first part 2*aa*, 2*bb*, 2*cc*.

In order to protect this stripped first part 2*aa*, 2*bb*, 2*cc* against corrosion, it is situated inside a first chamber 3 filled with wax and delimited by an envelope constituted of:

at a first axial end, a face of the perforated block 4, transversely, a rigid tube 6 which is of circular cylindrical shape, for example, and at the axial end opposite the block 4, a gland 5 through which the sheathed strands 2*a*, 2*b*, 2*c* pass in sealed manner and pressed in sealed manner against the interior face of the tube 6 by the effect of an axial compression.

The strands exit the anchor block 4 and form a second part 2*aaa*, 2*bbb*, 2*ccc* of the structural cable, also stripped. For the same reasons of protection against corrosion, this second part of the structural cable is contained in a second chamber 3*a* filled with a filling material which, in the example considered here, is a wax. The chamber 3*a* is delimited on the one hand by the anchor block 4 and on the other hand by a cap 9 drilled by two openings 9*a* and 9*b* closed by plugs.

The anchor block 4 includes two openings 4*a* and 4*b*, for example circular holes, used to fill the first chamber 3 with hot wax.

The chamber 3 is situated in an area of the anchor system 1 that is generally surrounded by the construction element. Because of this it is somewhat inaccessible.

Figure 1B:
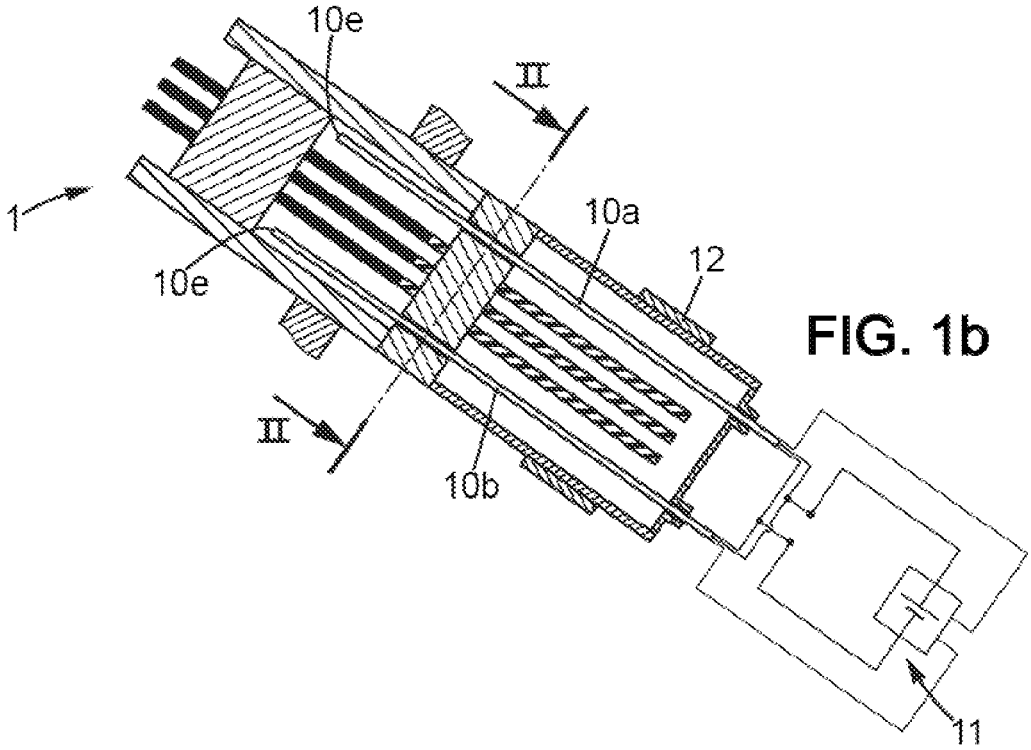
FIG. 1*b* shows a method of the invention of draining this anchor system.

FIG. 1*b* shows the same anchor system during the execution of a draining method of the invention.

In a variant of the invention that is not shown, the filling material present in the chamber 3*a* may be drained by removing the cap 9 to access it directly. It may be removed manually, if necessary by blowing hot air. In this case, the openings 4*a* and 4*b* are sealed, as are any openings corresponding to the passage of the strands 2*a*, 2*b*, 2*c* in the block 4.

During a first step, two heating elements 10*a* and 10*b* are inserted into the filling material that fills the first chamber 3. They have been inserted via the openings 9*a* and 9*b*. The heating elements 10*a* and 10*b* include a seal (not shown) so that when they are in place the openings 9*a* and 9*b* are sealed against flow of the fluidized filling material in the first chamber 3.

The heating elements 10*a* and 10*b* comprise a part of cylindrical shape with an end 10*e* that is pushed into the solid filling material.

To cause the heating elements 10*a* and 10*b* to enter the anchor system, they are then passed through the openings 4*a* and 4*b* in the anchor block 4. These are aligned with the openings 9*a* and 9*b* in the cap 9.

Once the heating elements have been installed, there commences a step of heating the filling material contained in the first chamber 3. This material is raised to a temperature higher than its melting point, but less than approximately 300° C. so as not to cause it to catch fire, and even less than approximately 160° C. so as not to damage the sheaths of the strands 2*a*, 2*b*, 2*c*.

To facilitate this control of the temperature in the first chamber, the heating elements 10*a* and 10*b* (see FIG. 3) may comprise a thermocouple 10*d* situated in such a manner as to measure the temperature at the end 10*e* of the heating elements. The thermal power dissipated by the heating elements is thereafter regulated as a function of the temperature measured by the thermocouples. Other thermocouples may be inserted into the first or second chamber to improve control of the fluidization of the filling material or to replace the thermocouples 10*d*.

When the filling material has melted (preferably completely melted), the heating elements 10*a* and 10*b* are removed and the fluidized filling material is able to flow in the passages created by the insertion of the heating elements. Instead of or in addition to this, the fluidized filling material may be aspirated via a cannula inserted either along the same path as the heating elements 10*a*, 10*b* or via an ad hoc opening in the envelope of the first chamber 3.

The filling material contained in the second chamber is generally easily removed by removing the cap 9. This material may also be heated without removing the cap. Heating may be effected with the aid of a heating belt placed on the external face of the cap 9. The heating elements 10*a* and 10*b* may also be configured so as to be able to heat the filling material contained in the second chamber 3*a*.

Figure 2:
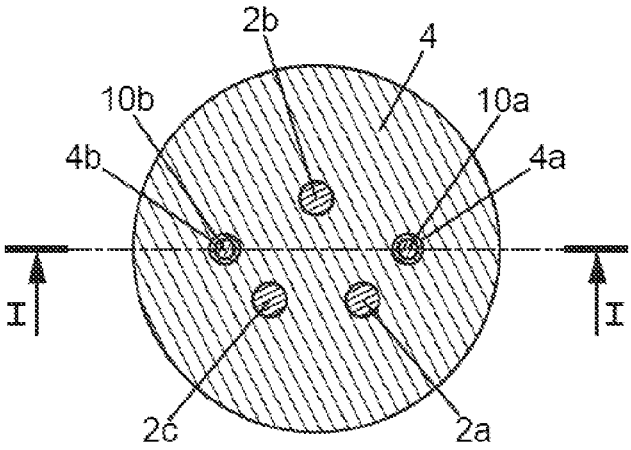
FIG. 2 is a cross section of the anchor system shown in FIG. 1*b;*

In FIG. 2 there are represented the strands 2*a*, 2*b*, 2*c* that pass through the anchor block 4. The fixing elements (jaws) are not shown. Also seen are the openings 4*a* and 4*b* through which the heating elements 10*a* and 10*b* are inserted.

Figure 3:
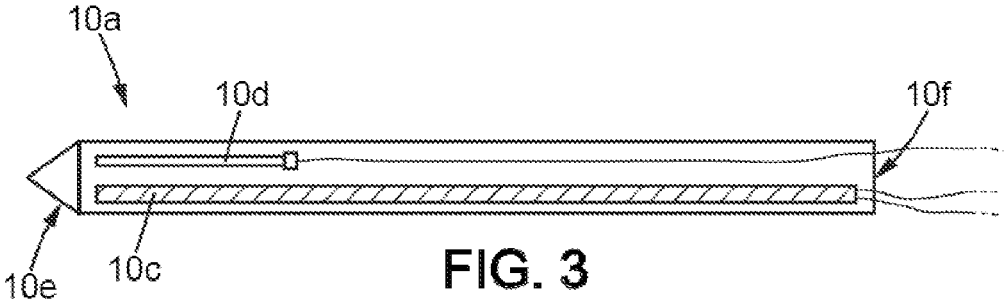
FIG. 3 shows a heating element used in the method illustrated by FIG. 1*b*.

FIG. 3 shows an embodiment of the heating element 10*a*. The element 10*b* is identical to the element 10*a*. The heating element 10*a* has an envelope the external surface of which is a circular cylinder. The section is slightly less than 10 mm. The element 10*a* has two opposite ends 10*e* and 10*f* of which one end 10*e* is intended to penetrate into the solid filling material in the chambers 3*a* and 3. It comprises an electrical resistance 10*c* disposed over the whole length of the envelope, as well as a thermocouple 10*d* placed in such a manner as to measure the temperature of the end 10*e*. Power supply wires of the resistor 10*c* and the thermocouple 10*d* exit via the end 10*f*.

During the heating step, each resistor 10*c* is connected to a current source 11 including a PID controller controlling the electrical current delivered to the resistor 10*c* (that is to say controlling the thermal power dissipated by the Joule effect) as a function of the temperature measured by the thermocouple 10*d*. If there is a plurality of resistors, each is preferably supplied with power and controlled autonomously. Control enables reduction of the heating time under a maximum temperature constraint.

The invention claimed is:

1. Method of draining a system for anchoring a structural cable to a construction element, the anchor system comprising a first chamber delimited by an envelope, the first chamber containing a first part of the structural cable and a first filling material, the method comprising inserting at least one heating element into the first filling material via an opening in the envelope of the first chamber;

heating the first filling material using the heating element to fluidize at least some of the first filling material; and extracting the fluidized first filling material via an opening in the envelope of the first chamber.

2. Method according to claim 1, wherein the heating element comprises a substantially cylindrical part having an end by which it is caused to penetrate into the first filling material during insertion.

3. Method according to claim 1, wherein the heating element comprises a thermocouple for measuring a temperature in the vicinity of the heating element.

4. Method according to claim 3, wherein, during heating, the heating element delivers a thermal power regulated as a function of the temperature measured by the thermocouple.

5. Method according to claim 1, wherein the heating element comprises an electrical resistor, the method further comprising connecting the electrical resistor to a current source.

6. Method according to claim 1, wherein, during heating, the opening of the envelope of the first chamber through which the heating element is introduced is sealed against flow of the fluidized first filling material.

7. Method according to claim 1, wherein the fluidized first filling material is extracted at least in part by aspiration using a cannula.

8. Method according to claim 1, wherein the fluidized first filling material is extracted at least in part by flow.

9. Method according to claim 8, wherein the fluidized first filling material flows through the opening that was used to introduce the heating element into the first filling material.

10. Method according to claim 1, wherein the envelope of the first chamber comprises an anchor block to which the structural cable is anchored, a tube and a gland, the opening through which the heating element is introduced into the first filling material during the insertion being situated in the anchor block.

11. Method according to claim 10, wherein the anchor system comprises a second chamber situated on the other side of the anchor block relative to the first chamber and delimited by a second envelope comprising the anchor block and a cap, the second chamber containing a second part of the structural cable and a second filling material and wherein, prior to the insertion of the heating element into the first filling material, the heating element is caused to penetrate into the second chamber via an opening in the cap aligned with the opening in the envelope of the first chamber through which the heating element is inserted to enable successive penetration of the heating element into the second chamber and then the first chamber without moving the cap.

12. Method according to claim 11, further comprising heating the second filling material by a heating belt placed on an external surface of the cap.

* * * * *